US006112522A

United States Patent [19]

Wright

[11] Patent Number: 6,112,522

[45] Date of Patent: Sep. 5, 2000

[54] TOTAL FLOW LIQUID PISTON ENGINE

[76] Inventor: Harlow Wright, 27 Wildly Dr., Roswell, N. Mex. 88201

[21] Appl. No.: 09/189,186

[22] Filed: Nov. 10, 1998

[51] Int. Cl.[7] ..... F01B 29/08

[52] U.S. Cl. ..... 60/516; 60/531

[58] Field of Search ..... 60/516, 530, 531

[56] References Cited

U.S. PATENT DOCUMENTS

| | | | |
|---|---|---|---|
| 3,659,416 | 5/1972 | Brown | 60/25 |
| 3,688,502 | 9/1972 | Hasen | 60/56 |
| 3,751,673 | 8/1973 | Spankel | 60/26 |
| 3,916,626 | 11/1975 | Schur | 60/496 |
| 4,041,705 | 8/1977 | Siegel | 60/497 |
| 4,121,420 | 10/1978 | Schur | 60/531 |
| 4,130,993 | 12/1978 | Erazo | 60/721 |
| 4,135,366 | 1/1979 | Siegel | 60/497 |
| 4,233,813 | 11/1980 | Simmons | 60/496 |
| 4,388,805 | 6/1983 | Rideout, Jr. | 60/516 X |
| 5,720,169 | 2/1998 | Schneider | 60/530 |

*Primary Examiner*—Hoang Nguyen

[57] ABSTRACT

This invention uses a body force to trap the liquid component of a fluid in local potential minimums in a continuous cavity in an expander. Shaping of the cavity traps the vapor components of the fluid between these "liquid pistons". In the external combustion embodiment, the cavities have a continuously increasing cross section. Therefore, the surface pressure of the fluid generates an unbalanced force on the containing expander. The cavities are shaped such that components of the unbalanced forces combine to generate a torque, which rotates the expanders. In the preferred embodiment, some of this rotational force is fed back by gearing to revolve the expanders around a rotor axis. This revolving generates a centrifugal body force on the fluid in the expander cavities. In the internal combustion embodiment, the expander stages are preceded by decreasing cross section stages which compress the fuel air mixture. The mixture is ignited and expands in the following stages. This expansion allows external work to be done.

4 Claims, 7 Drawing Sheets

Diagramatic Cross Sections Radial Flow Cylinder

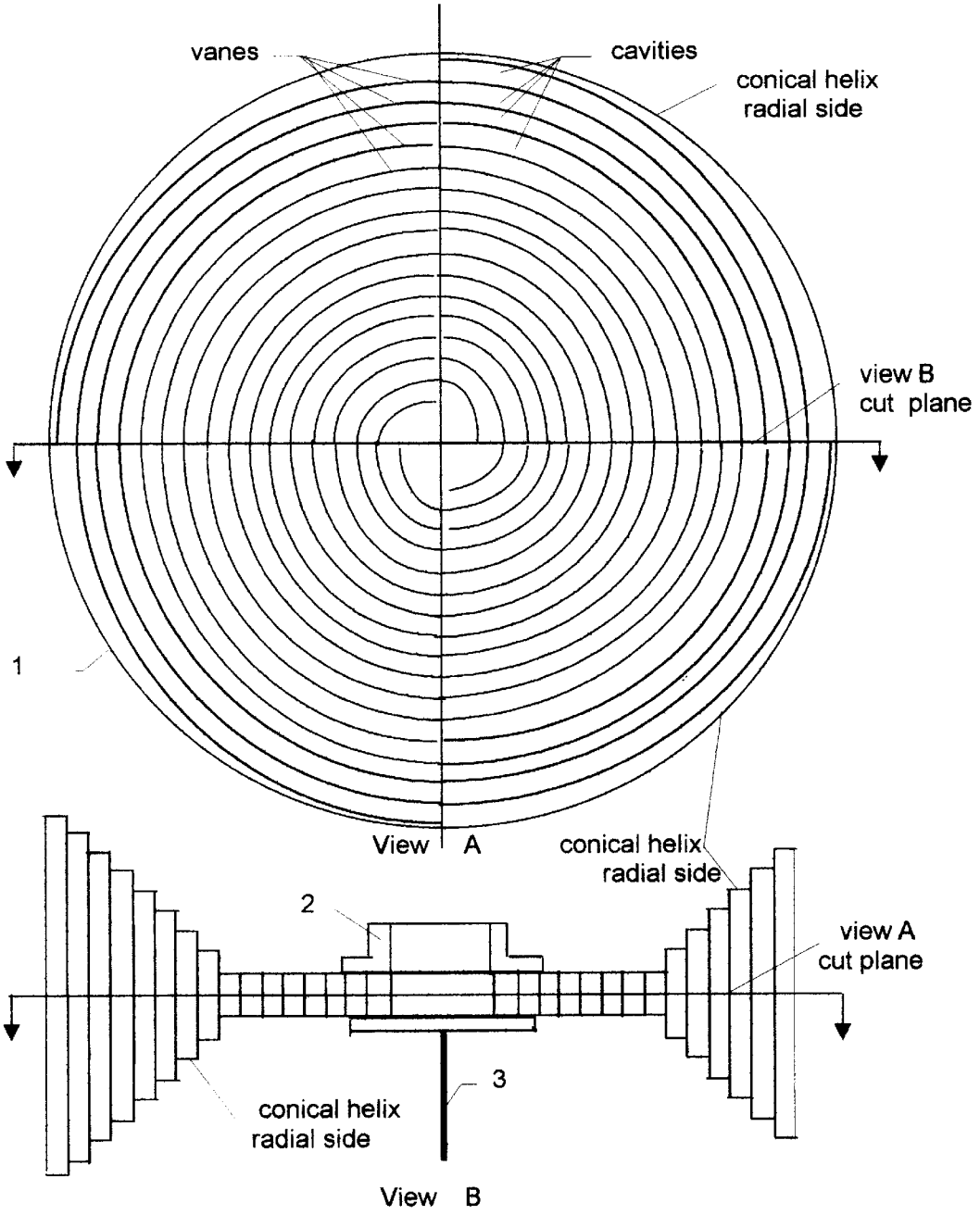
Figure 1 Diagramatic Cross Sections Radial Flow Cylinder

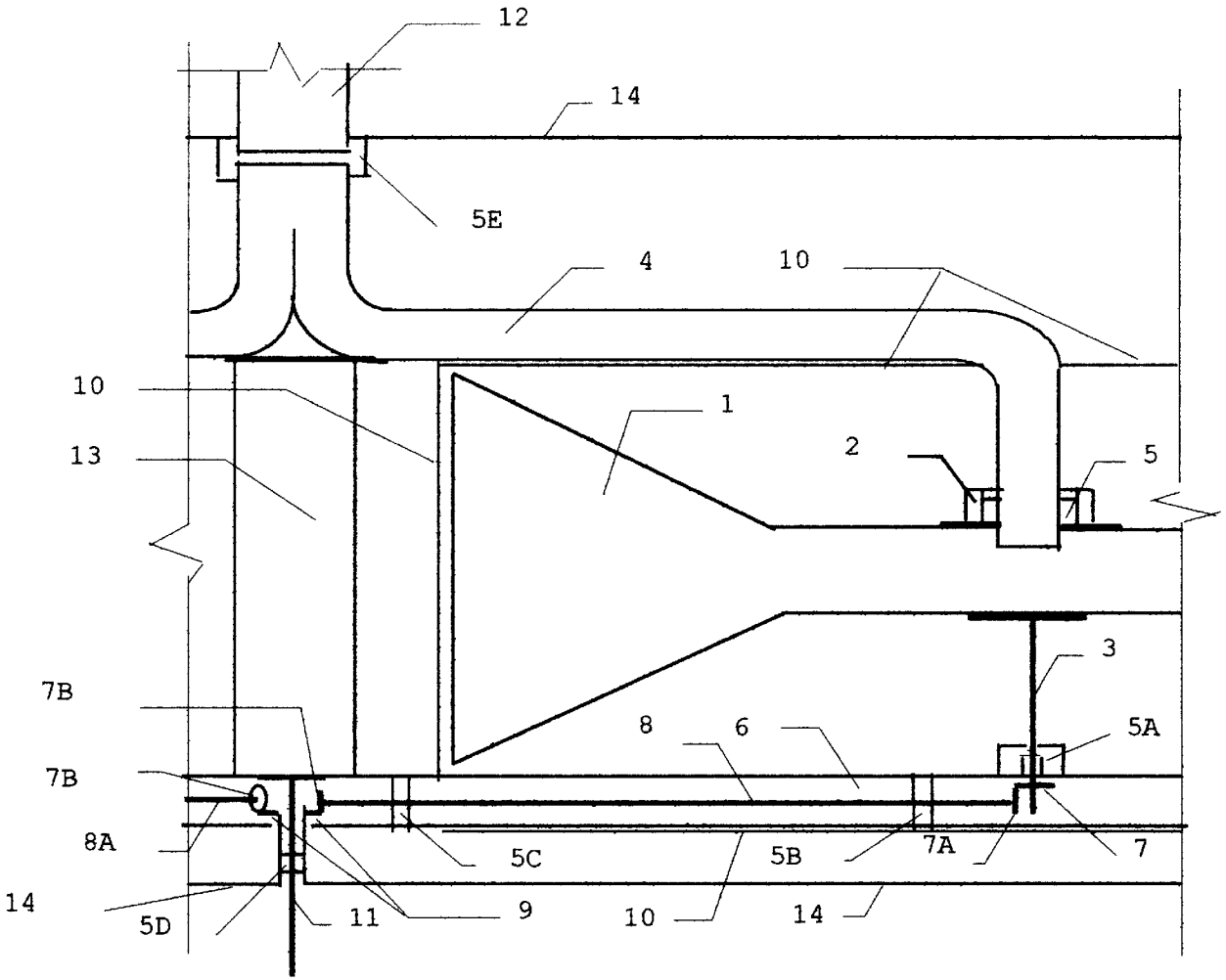
Figure 2 Partial Cross Section Expander Assembly

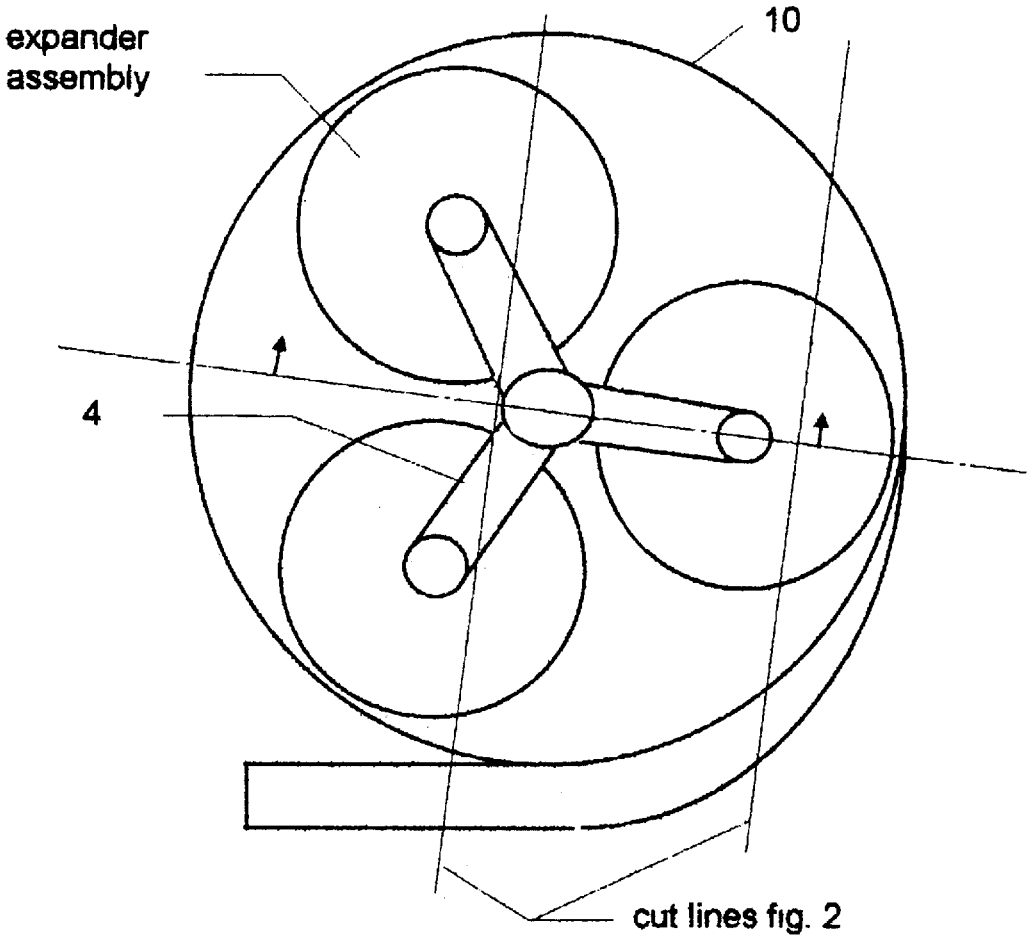
Figure 3 Top View Rotor Assembly

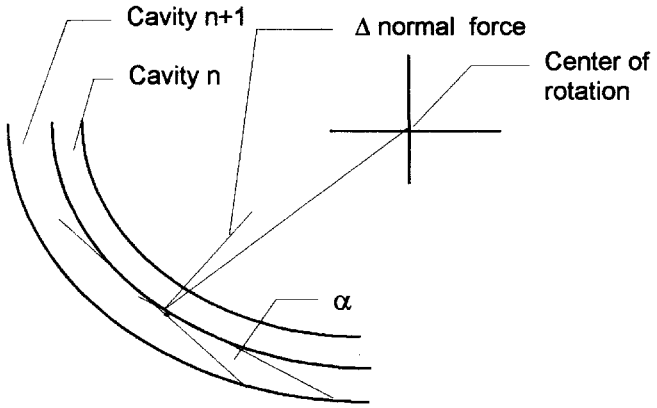
Figure 4 Schmeatic Of Torque Generating Forces
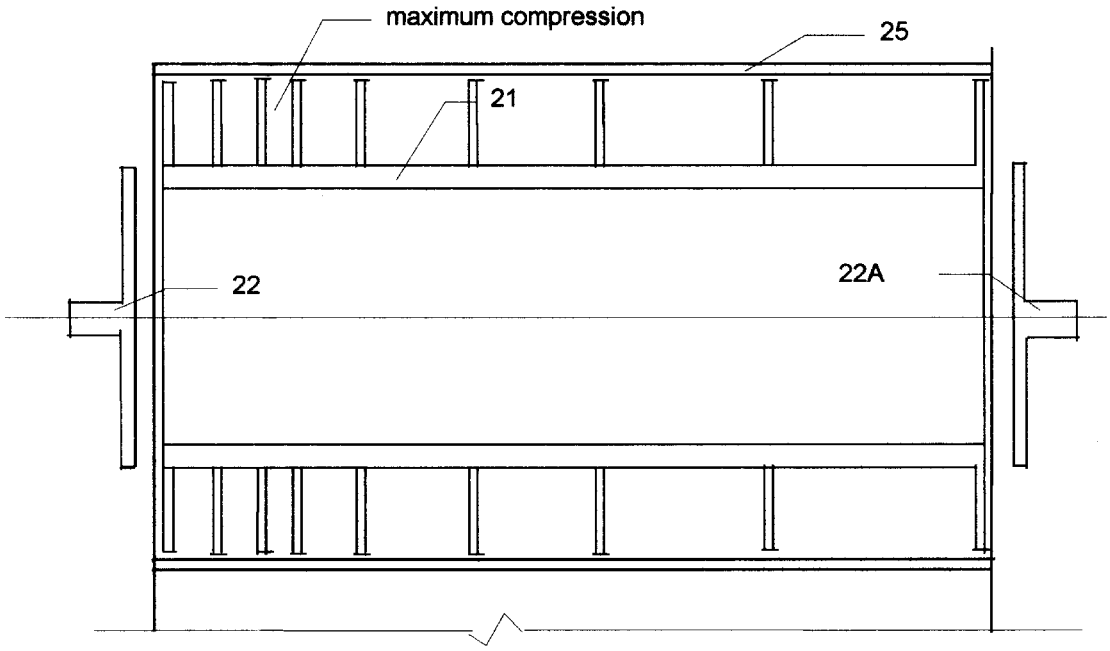
Figure 5 Axial Cross Section Expander Assembly ICE Embodiment

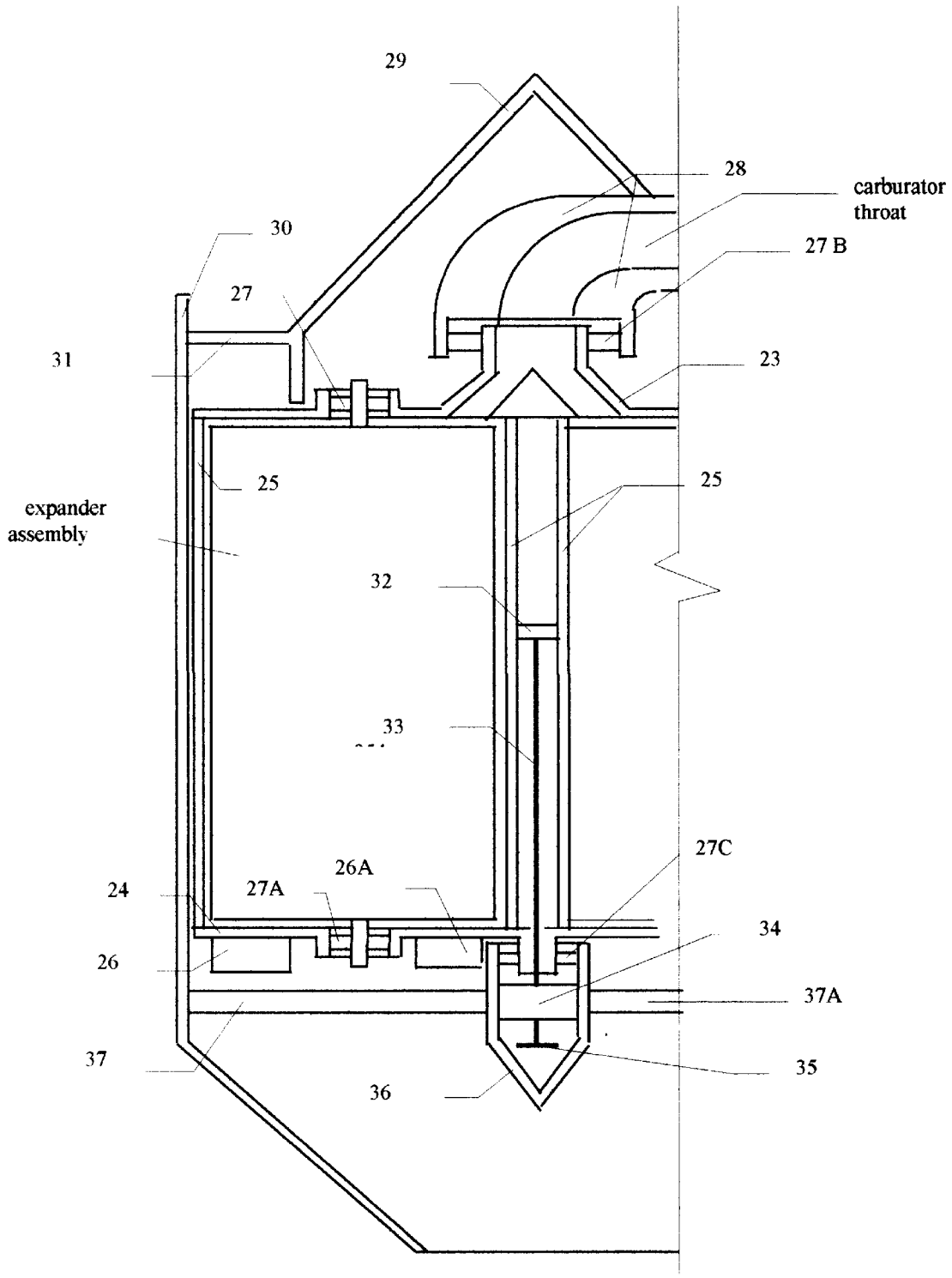
Figure 6 Partial Cross Section ICE Embodiment

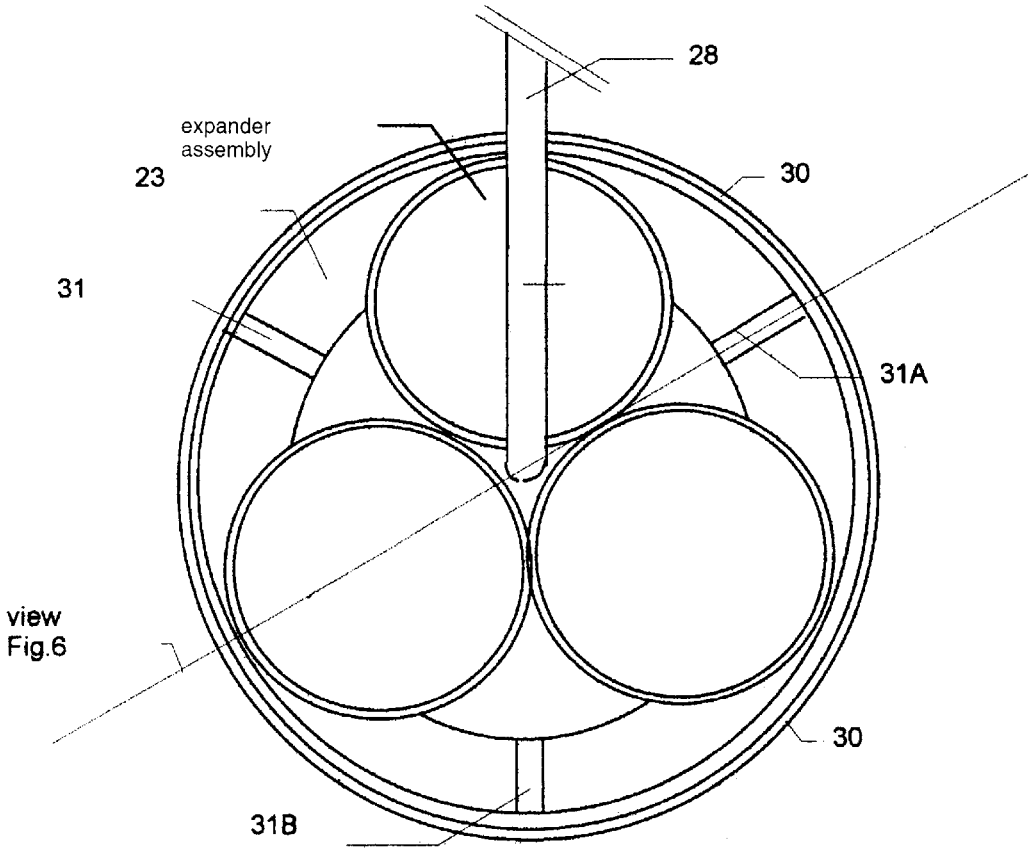
Figure 7 Top View Rotor Assembly ICE Embodiment

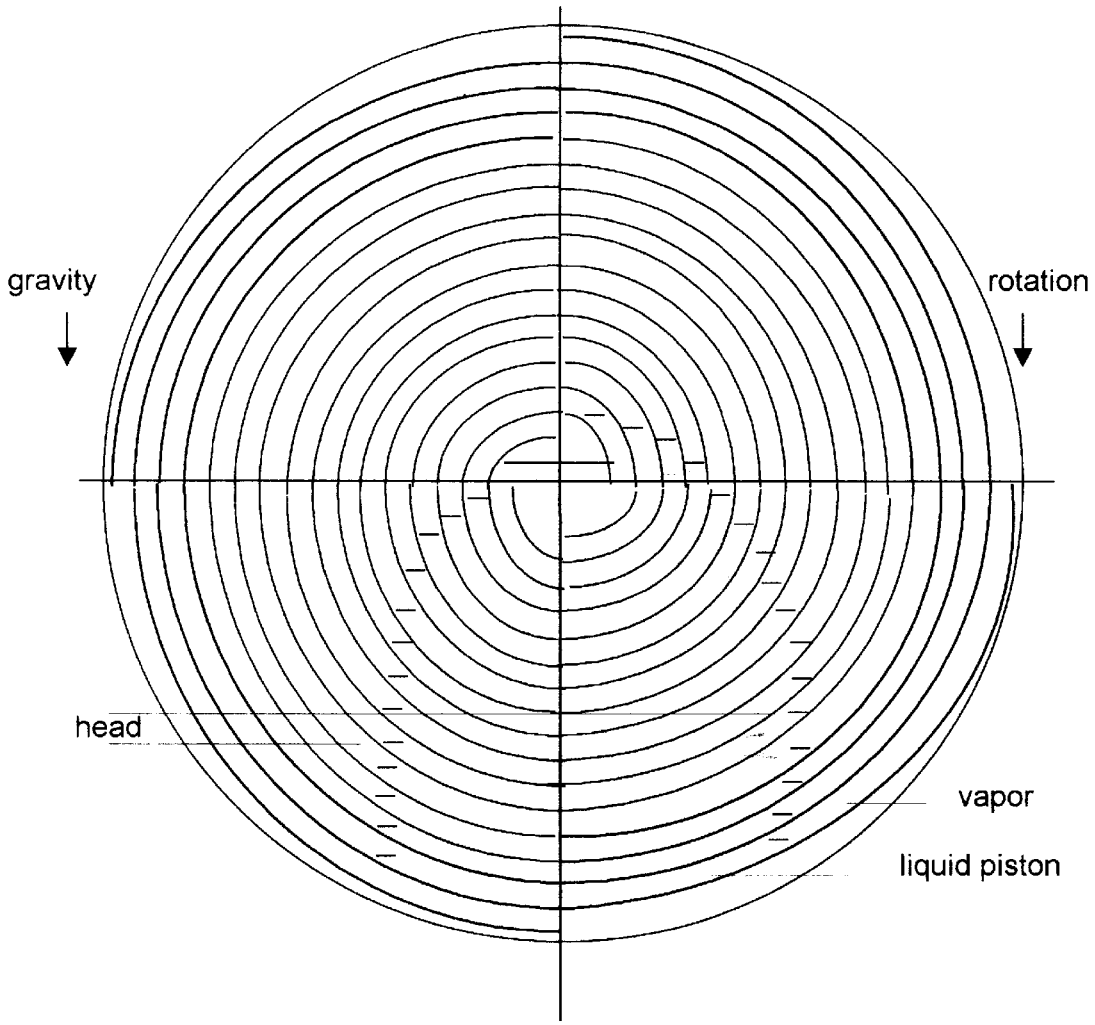
Figure 8 Schmetic Of Confinement In Cavities

TOTAL FLOW LIQUID PISTON ENGINE

CROSS REFERENCE

This Application is a rewriting of 08/659,508 abandoned due to untimely response by applicant.

BACKGROUND

1. Field of the Invention

This invention relates to engines that convert the enthalpy of two phase fluids into rotary motion; specifically to a rotary engine which uses a body force (inertia) and structural shape to sequentially restrict the liquid phase of a two phase fluid to angle dependant potential minimums thereby creating "liquid pistons" which confine both phases. Angle dependant cross sections of the enclosing volume allow the volume between pistons to increase with rotation. The resulting differential surface pressure on the rotor surfaces generates torque, rotating the cylinder permitting the performance of external work.

2. Description of Prior Art

Their inherent power density and efficiency have allowed the turbine, in various forms, to dominate large scale power generation applications. Except for trains, steam and gas turbine versions dominate large vehicle propulsion. However, the turbine is very sensitive to solid, even liquid drop contamination and unsuitable for mixed phase fluids. The LAWRENCE LIVERMORE LABORATORY (LLL) terminated their DOE funded program to develop a total flow replacement engine or a total flow turbine compatible with geothermal fluids after an extensive multi-year program. Geothermal applications now either flash the fluid to steam or use heat exchangers despite the resulting much lower efficiency and increased cost.

Several low temperature differential heat sources—salt ponds, ocean water layering, etc.—have been extensively studied but attempts to develop these low density power sources using turbines have failed due principally to the need to use heat exchangers to achieve high quality, pure working fluids. These greatly decrease the efficiency and increase costs.

While the conventional piston engine is less sensitive to solid contaminants than the turbine, a comparatively low power density prevents its use for geothermal applications. further, geothermal sources are essentially saturated liquids and the resulting lubrication problems and possibility of liquid lock further reduce the piston engines' suitability for total flow applications.

The vapor piston engine is not competitive with the turbine and the turbine, while in subsidized use, is not commercially viable in these applications.

Increasing concerns about pollution have resulted in attempts to replace the internal combustion engine with the comparatively pollution free external combustion engine for vehicle propulsion. These attempts initially used conventional vapor piston engines. Limited success resulted in attempts to improve the basic engine and then different architectures. One of the leaders in this research, Lear, alternately used piston engines, a Lysholm screw expander and turbines before terminating his effort.

Low-level efforts to achieve commercial success by modifying the piston engine continue but none are promising.

A rugged, low cost, high power density, total flow engine not requiring the use of heat exchangers would facilitate the use of geothermal fluids and permit the use of many low density heat sources for power generation. One does not exist and the basis for one is not described in the literature or patents.

Efforts to develop commercially useful total flow engines for these applications have led to the invention of several novel architectures. Typical examples of these, most closely related to my invention, are described below.

Schur—in U.S. Pat. No. 3,916,626—describes the most direct representative of one class, the bubble wheel. This engine is a direct inversion of the overshot water wheel in that instead of adding heavy water to one side of a wheel in air they add vapor to the other in liquid.

Schur—U.S. Pat. No. 4,121,420 and Simmons—U.S. Pat. No. 4,233,813—describes versions of this technique in which the vapor is introduced by use of directing bellows.

Brown—U.S. Pat. No. 3,659,416 describes a version of this technique in which the fluid is confined in the rotor but moved from the up to down side by vapor pressure generated by the heating of the liquid on one side of the wheel.

These engines share the very low power density of the water wheel. They do not use the surface pressure of the fluid to generate power, only to move liquid that then falls in a body force field. In these engines an increase of surface pressure beyond that necessary to move the liquid would not increase the power output.

In addition Brown's engine as described poses very difficult heat transfer problems as both heating and cooling must take place in the rotor. They can be modified to flow through versions but would still share the power density limitations.

Siegel—U.S. Pat. Nos. 4,041,705 and 4,135,366—describes engines in which the fluid is moved from one side to another of a two chamber container. The variation in level is coupled by use of a float to the power extractor. As stated, the vapor and liquid need not be of the same substance and a very dense liquid can be used. However, even with the densest liquid available, power density would be very low.

Erazo—U.S. Pat. No. 4,130,993—describes an engine in which a rotor, mounting rings, which permanently confine a liquid, is rotated by the flowing liquid. The fluid flows continuously because of a fixed density difference maintained by differential heating.

The use of centrifugal force to replace gravity as the body force greatly increases the possible power achievable by moving the liquid: but, the heat flow problems in the rotor impose very severe power density limitations.

The engines described above do not have the power density required for commercial success. Schur recognized this and moved from free bubbles to a bellows (piston) to create the low density volume. However, a piston is more efficient and achieves a much greater power density when applied directly to the load as in the conventional piston engine. None of the inventions described above are competitive with the conventional piston engine.

Hansen—U.S. Pat. No. 3,688,502—achieves an increased thruput, as compared to the piston engine, in a novel true turbine by allowing the fluid to flow directly through spiral grooves in two disks in contact. The grooves in the input disk decrease in cross section while those in the output disk increase as a function of distance along the spiral. A closely fitting shroud prevents escape of the fluid from the groves. The liquid and its momentum are transferred from the input to output disk. Either the output or both disks can rotate doing work.

The injector nozzles used require preconditioning of geothermal fluids. However, this turbine should be less sensitive to contaminants than conventional forms. This is its only obvious advantage when compared to conventional turbines. It is not obvious that it is as efficient as conventional versions or that it could use two phase fluids efficiently. Its power density would be much less than conventional turbines.

Spankle—U.S. Pat. No. 3,751,673—describes a version of the Lysholm screw expander. He discusses geothermal applications. The Lysholm is a positive displacement engine with the expansion chamber being defined by the intermeshing of the continuous lobes of a male rotor with continuous grooves in a female rotor—both closely fit by a cover which prevents fluid escape. Torque to rotate the rotors is generated by differential surface pressure on the rotor "fins". The differential pressure is maintained by the sequencing of the chambers. Leo—U.S. Pat. No. 4,228,657—describes a regenerative version of this expander and provides a concise discussion of its operating features with extensive references.

The necessary close fitting of the lobe and grooves in the male and female rotors and their slow withdraw from each other as a function of angle severely limits the volumetric efficiency of this engine. In addition, volumetric efficiency is halved by the use of two rotors to define a volume.

Despite its low power density as compared to the turbine, the ruggedness and simplicity of the Lysholm expander has resulted in its wide consideration for geothermal applications. As stated above, it was considered for vehicle propulsion by Lear. This expander approaches commercially viable performance to cost ratios for several applications. However no existing version, and no version described in the literature, provides the performance to cost ratio margin over conventional engines required to achieve commercial exploitation.

OBJECTS AND ADVANTAGES

The principal object of this invention was the design of a heat engine that could commercially generate power from renewable geothermal, salt pond, and ocean thermal layer sources. To be commercially successful, such an engine must:

1, approach the power density of the turbine at both small and large scale 2, approach the efficiency of the turbine at both small and large scale 3. be less expensive to design and manufacture than the turbine 4. be less sensitive to impurities and variations in the liquid to vapor ratio than the turbine.

Analysis indicates that such an engine must have the following, not necessarily independent, characteristics:

1, be total flow 2, be insensitive to fluid contamination 3, achieve efficiency without heat exchangers 4, require simple design techniques as compared to turbines 5, require simple manufacturing techniques as compared to turbines.

Accordingly several advantages of my invention are:

The total flow characteristic:

1 allows the utilization of a much greater percentage of the heat content of mixed phase fluids.

2, avoids the costs and inefficiency of heat exchangers.

All embodiments are rotary and continuous flow with no hardware being time shared between operational phases—power is extracted from the fluid continuously in the expander. Even in the internal combustion embodiment, hardware is not time shared between phases as with the piston engine. This design characteristic:

1, greatly increases power density 2, allows the design of hardware implementing each function to be optimized for this function.

3, allows more time for each function to be implemented without loss of power.

Increased combustion time increases the completion of combustion in the ICE embodiment thus increasing the possible fuels, combustion temperature, and materials.

Being functionally a piston engine with liquid fit, the only requirement of the solid is containment and low drag. This design characteristic:

1, reduces design time and required manufacturing precision.

2, greatly reduces leakage 3, reduces oiling difficulties.

Rotary design also avoids the complexity, cost and power loss associated with the conversion of linear to rotary motion.

The low initial design and tooling costs allows engine details to be optimized for each application. This, and the performance features, permits utilization of small heat sources such as salt ponds. It also permits use of the engine in standby applications.

Still further objects and advantages will become apparent from a consideration of the ensuing description and accompanying drawings.

This invention shares the load coupling advantages of the conventional piston vapor engine in that power shaft and body centrifugal force generating rotation can be separated. In such embodiments, the engine develops maximum torque at zero power shaft speed. The separation of power output and body force generation rotation allows low temperature low quality fluid to maintain the centrifugal force while reducing power consumption and allowing high temperature fluid to be stored for power bursts. Further, this separation allows the coupling of power to load to be accomplished with only a clutch avoiding the use of expensive, efficiency reducing transmissions.

The achievement of vapor confinement by the liquid component of a two phase fluid results in a confining volume change that is similar to that of the vane type engine such as the Mallory. However, it avoids the leakage and fitting problems of this engine and the liquid lock problems of the conventional piston engine.

Still further objects and advantages will become apparent upon consideration of the ensuing descriptions and drawings

BRIEF DESCRIPTION OF THE DRAWINGS

FIGS. 1A and 1B is a horizontal and a vertical cross section of the cylinder for the preferred radial flow embodiment FIG. 2 is a partial horizontal cross section of the rotor assembly FIG. 3 is a top view of the rotor assembly for the preferred embodiment FIG. 4 is a schematic of the torque generation forces FIG. 5 is an axial cross section of the ICE cylinder assembly FIG. 6 is a partial axial cross section of the ICE embodiment FIG. 7 is a top view of the rotor assembly for the ICE embodiment FIG. 8 is a schematic of body force confinement of the liquid and the liquid confining vapor in the vane and radial wall defined cavities

REFERENCE NUMERALS

External Combustion Embodiment

1 radial cylinder
2 plate-anus
3 plate-axle
4 rotor-feed
5 oiled, sealed bearing
5A oiled, sealed bearing
5B oiled, sealed bearing
5C oiled, sealed bearing
5D oiled, sealed bearing
6 trifurcated rotor-nacelle mount
7 gear
7A gear
7B gear
8 torque shaft
9 ring gear
10 nacelle
11 power axle
12 feed pipe
13 structural drum
14 shroud Internal Combustion Embodiment

21 axial cylinders
22 plate-axle
22A plate-axle
23 manifold
24 rotor mount
25 cylinder cover
26 turbine
26A Turbine
27 oiled, sealed bearing
27A oiled, sealed bearing
27B oiled, sealed bearing
28 carburetor duct
29 inlet cone
30 nacelle
31 fairing
31A fairing
31B fairing
32 ignition sub-assembly
33 connecting rod
34 alternator
35 manual start pulley
36 exit cone
37 fairing
37A fairing
37B fairing
37C fairing

SUMMARY

This invention consists of a solid containing continuous cavities shaped by enclosing vanes orthogonal to and sides parallel to the axis of the solid and mounted such that there is a repetitive pattern of minimums along the cavities with respect to a body force (inertia, gravity). Due to different densities, the two components of a two phase fluid filling the cavities separates with the denser liquid component coming to rest in the local minimums therby forming a sequence of "liquid pistons". These pistons partition the cavities into a sequence of closed segments confining both phases of the fluid. When the cylinder is mounted on a central axle and rotated with respect to the body force, the minimums move and the volume between pistons increases. With continous rotation the surface pressure of the confined fluid on the vanes is different on the two sides of the vanes—due to the variation of the volume—and generates a torque about the cylinder axles tending to continue the rotation. The expansion of the fluid allows the performance of work. Part of this can be recovered to impose the body (centrifugal) force on the fluid. Another part can do external work.

By providing a carburetor to inject a fuel-air mixture in the vapor section of the cavity, including a decreasing cross section at the front to compress this mixture and a means of igniting the mixture after compression, the engine becomes an internal combustion pump. In an axial flow configuration, it is an efficient means of propelling marine vehicles.

Preferred External Combustion Embodiment—Description

The preferred external combustion embodiment consists of a rotor assembly, which contains three expander assemblies, various gearing, and shafts which couple the rotation of the expanders to the rotor and provide for power take-off. A shroud covers the whole.

FIG. 1 sheet 1 presents horizontal and vertical cross sections of a radial flow expander assembly. Each expander consists of a cylinder 1, a plate-anus 2 and a cylinder plate-axle 3. The cylinder contains four Archimedes spiral vanes forming the axial walls of 4 cavities. The radial (outer) walls initially form a flat and then a conical helical strip. The entrance to the cylinder mounts the plate-anus. The opposite side of the cylinder mounts the cylinder plate-axle.

FIG. 2 presents a partial cross section—placed and cut as shown in FIG. 3—of the mounting of an expander assembly. The plate-anus 2, rigidly fixed to the cylinder 1, is mounted to the rotor-feed 4 by an oiled, sealed bearing 5. The cylinder plate-axle 3, rigidly fixed to the cylinder, penetrates the shaft cover-rotor mount 6, to which it is mounted by oiled, sealed bearing 5A.

A gear 7 is fixed to the cylinder plate-axle 3 and meshes with a gear 7A fixed to torque shaft 8. This torque shaft is mounted to the shaft cover rotor mount 6 by oiled, sealed bearings 5B and 5C.

A gear 7B is fixed to other end of the torque shaft 8 and meshes with a ring gear 9 rigidly fixed to the shroud 14.

A power axle 11 is fixed to the structural drum 13, penetrates the shaft cover-rotor mount 6, penetrates the ring gear 9 and is mounted to the shroud 14 by oiled, sealed bearing 5D. It then continues to the power takeoff—not shown.

The rotor-feed 4 is fixed to the feed pipe 12 by an oiled, sealed bearing 5E. The feed pipe is fixed to the shroud 14.

The structural drum 13 is fixed to both the rotor-feed 4 and the shaft cover—mount 6.

FIG. 3 shows a top view of the rotor assembly mounting the nacelle covered expander assemblies as mounted on the rotor-feed 4 and the shaft cover-rotor mount 6. The shroud 14 surrounds the rotor assembly. The shroud has the conventional centrifugal pump outlet shape.

Preferred External Combustion Embodiment—Operation

Engine Operating Principles

Any useful piston heat engine must dynamically confine the operating fluid and the forces generated by this confinement must result in powered motion that can be coupled externally to do useful work.

The technique for meeting these universal requirements in the Liquid Piston Engine described here is based on the difference in the ratio of body forces (forces that act directly on each particle of a mass) and surface forces (forces that act only on the surface) for the liquid and vapor components of a two-phase fluid. In the implementations shown, the body force is inertial—centrifugal. The surface force is vapor pressure.

Fluid Confinement

The method of confining the liquid is most easily understood by assuming operation in a gravitational field, this is done here.

Assume the cylinder of FIG. 1 sheet 1 is mounted vertically on the plate-anus 2 and plate-axle 3 in a gravitational field as shown in FIG. 1 sheet 2. Let an external hot two-phase, adjustable pressure fluid source be connected to the plate anus 3. At low pressure, turn the cylinder clockwise until a piston is formed in the first cavity. Increase the fluid pressure and again turn the cylinder until another piston is formed. Continue this process, making sure not to have enough pressure on any piston to make it overflow into the next minimum, until there are liquid pistons in all low sections, then stop.

The distributions of liquid and vapor will resemble that shown in FIG. 1 Sheet 2.

With this set-up procedure, there will be a difference in the heights of the two sides of all the pistons—a head. Neglecting the weight of the vapor the total head—the sum of the individual heads—will add up to the head between the source and the outlet pressure.

There will be desirable heat exchanges between the fluid and vapor. These allow the recovery of the enthalpy of the liquid which will not expand put contract as it cools. Undesirable heat exchanges will take place across the ends of the pistons and the trapped vapor and through the walls. These are conventional problems.

It is seen that if the cylinder is revolved about an axis off the cylinder, a centrifugal (body) force will be generated on the liquid component. The centrifugal force can be much greater then gravity and it will permit a proportional increase in power density.

Torque Generation

A set of coordinates can be erected at any point on the axial surface of a cylinder, as shown in FIG. 4, with one axis orthogonal to and penetrating the axis of rotation, a second axis parallel to the rotational axis, the third axis completing an orthogonal set as shown in the drawing. Surface pressure of a fluid—neglecting friction—acts normal to the surface. As the normal to the spiral, at any point, does not go through the cylinders axis of rotation, nor is it parallel to the axis of rotation, it has a component orthogonal to the radius and axial coordinates. Therefore, any net surface pressure across any area of the axial wall will generate a torque about the axis of rotation.

Assuming a simple Archimedes spiral ($r=a\theta$) and that the width of the cavity is constant (not true of FIG. 1), the torque can be written:

$$T=rF \sin \alpha=r\Delta P \sin \alpha \, da$$

Where, F is the force across a wall parallel to the axis and $\Delta P$ the pressure differential in the two cavities.

By inspection, for the geometry shown, $\sin \alpha$ is always of the same sign and never zero. Therefore, the integrated torque is positive if the pressure differential is always positive (outward).

As the volume between pistons centers (for the constant width example) increases proportional to total angle, and therefore to r, the fluid will expand and the differential pressure will have the positive direction shown: the pressure on the spiral walls will be unbalanced and a positive torque generated.

In the preferred external combustion embodiment shown in FIG. 1, the outer sections of the cavity increases in width. By the same logic as above, for these sections, there will be a torque generated on the axial walls tending to rotate the expander in the positive direction. Further, the two factors increasing the volume with r multiply, further increasing the differential pressure and therefore the torque.

In a gravitational or centrifugal force field; a cylinder such as illustrated above and filled by a hot two phase fluid will generate a torque about a central axis; and if free to—and no greater opposing torque is imposed—will rotate such that the fluid expands. Provided with replacement for the hot fluid the cylinder will continue to do so A more general and useful—but less intuitive—explanation of the torque generation can be based on the laws of Thermodynamics. In differential form the mechanical work done by a confined, expanding fluid can be written $$dW=P \, dV.$$

In this equation dW is the mechanical work, P the fluid pressure and dV the differential volume change.

This equation allows the designer of a piston engine to describe the performance of an engine by the mass flow rate, expansion ratio and efficiency; no detailed analysis of the forces is required. This allows the comparison of engine designs in terms of factors, which contribute, to inefficiency—average temperature, mixing of fluids of different temperatures and mechanical losses.

Body Force Generation

The surface force—vapor pressure—is an intrinsic temperature dependent characteristic of the fluid. It is only necessary to show how the body force—centrifugal force in the preferred embodiments—is generated.

The gearing of any rotation of the cylinder 1 to the non-rotating shroud 14 through the cylinder plate-axle 3, gears 7 and 7A, torque shaft 8 and ring gear 9; creates a torque on the rotor assembly as shown in FIG. 2. This causes the rotor assembly and power axle 11, to revolve with respect to the fixed feed pipe 12 This revolving of the offset expanders results in a centrifugal force being imposed on the contained fluid creating the local, centrifugal force minimums in which liquid pistons are formed. This in turn causes the expander assemblies to rotate on their axis,due to the unbalanced torque of the pressurized fluid, completing the cycle.

External Fluid Handling

The fluid is assumed to be delivered to the engine by the feed pipe 13 from a geothermal well, boiler or other hot fluid source.

For open cycle operations, such as geothermal, the output fluid will be delivered to a disposal site. For closed cycle operations, it will be fed to a condenser or separator.

Preferred Internal Combustion Embodiment—Description

The ICE embodiment consists of the expander assembly, rotor, electrical and nacelle assemblies, carburetor, mounting bearings and mounting fairings.

As shown in FIG. 5, the expander assembly consists of the axial flow cylinder 21, the inlet mounting plate-axle 22 and the exit mounting plate-axle 22A. Only one of the assemblies is shown in detail. The structure of the others is determined by the threefold symmetry.

The rotor assembly, as shown in FIG. 6, consists of the manifold 23, the rotor mounting plate 24, the cylinder cover 25 and the turbine blades 26 and 26A.

The three expander assemblies, as shown in FIG. 7, are mounted to the rotor assembly at the manifold 23 by oiled, sealed bearings 27 on the inlet mounting plate-axles 22 and by oiled, sealed bearing 27A on the exit mounting plate-axles to the rotor mounting plate 24.

As shown in FIGS. 6 and 7, the expander assemblies fit inside the trifurcated expander cover 25, which is fixed between the manifold 23 and the rotor mounting plate 24. The trifurcated expander covers closely fits the outside of each expander assemblies, sealing the outside but allowing the assemblies to rotate within it. It rigidly connects the manifold and mounting plate.

The manifold is mounted to the carburetor ducting 28 by oiled, sealed bearing 27B. The carburetor ducting penetrates and is fixed to the inlet cone 29 and to the nacelle 30. As shown in FIG. 7, the inlet cone is fixed to the nacelle by failings 31, 31A and 31 B.

On the outside—most distant from the rotor axle—the manifold is cut away to expose the input to the expanders, allowing the incoming liquid to enter. As shown in FIG. 6, it contains a central cavity—carburetor throat—, which allows the fluid air mixture from the carburetor to enter the cylinders when on the inside—nearest the rotor axle.

The electrical assembly contains an ignition subassembly 32 fixed to the expander cover 25. This rigidly mounts three glow plugs—not shown. This assembly also rigidly mounts a hollow drive rod 33, which penetrates a mounting boss on the rotor mounting plate 24 and drives the alternator 34. The drive rod contains an electrically conductive core which is inductively connected to the alternator and the glow plugs. It may be electrically connected to the vessel's battery if desired.

The drive rod 33 is the axle of the alternator rotor and extends beyond it's housing to mount a manual start pulley 35.

The alternator is fixed to the exit cone 36. The exit cone is fixed to the nacelle by three failings 37, 37A and 37B.

Preferred Internal Combustion Embodiment—Operation

Every engine is a possible pump capable of moving fluid. With minor modifications, a device capable of moving fluid and/or extracting power from its expansion is a potential internal combustion engine. By adding compressive stages in front of the expanding ones, the radial expander described above can be used in such a configuration to generate power.

One of the advantages of the liquid piston engine is its large mass flow rate: it is a potential marine direct propulsion device. For such an application, as with the turbojet, an axial flow expander is more efficient than the radial flow configuration. The preferred internal combustion embodiment uses the axial flow geometry.

In this embodiment, the engine achieves the desired end by moving the liquid directly and functionally corresponds to a turbojet not the turboprop.

In addition to the compressor stages, a fuel air input and glow plugs for igniting the fuel air mixture are added to the external ECE embodiment. The boiler and condenser are eliminated.

In the axial cylinder shown, the cavities have a constant depth, therefore the radial component of the surface pressure goes through the axle and generates no torque on the expander. However the radial walls are not orthogonal to the axle due to the increasing width; therefore, there is a component of the pressure that is does not go through the axle nor is it parallel to the axle. It generates the torque.

FIG. 5 is a cross section of the expander assembly. It has leading compressive followed by expanding stages. The pumping compressor stages generate a torque that attempts to turn the expander in the opposite direction from the expanding stages. They must be powered. The length and ratio of expansion to compression stages is such that the expander turns so as to move the mixture and trapped water to the exhaust.

FIG. 6 a partial cross section of the novel portions of the axial total flow liquid piston ICE with the view and cut as shown is FIG. 7.

In operation, liquid is continuously fed around the intake fairings, through the cutaway portions of the axle-plate 22 into the outer portions of the cylinder 21. The liquid is propelled partially by the ram effect of motion, partially by the vacuum created by the movement of the prior liquid piston toward the exhaust. It is trapped in the outer portions of the cavities by the centrifugal force generated by the rotation of the rotor, and moved to the exit by the relative rotation of the expander with respect to the rotor. It exits the expander through the outer turbine ring 26. The turbine ring recovers most of the rotary momentum and forces the fluid to exit the engine parallel to the axis.

Simultaneously, fuel and air are mixed by the conventional carburetor (not shown) and fed to the manifold 23 through the carburetor throat. From there, it enters the inner portion of the cylinder cavities. The entering vapor is trapped when the next piston is formed and compressed by the decreasing cross section compressor stages. It is moved to the region of minimum cross section and there ignited by the glow plugs. It expands, increasing the surface pressure and causing the expander to turns. The fluid moves rearward with expander rotation through the expanding stages of the cylinder and exits through the inner turbine ring 26A.

The fuel air mixture is compressed before ignition to increase the efficiency. As the mixture is in contact with the liquid and water vapor (similar to water injected conventional piston engines) and has a long burning time: a fuel such as bunker four can be used.

The two turbine rings in the rotor mount are in the expander exhaust and recover a portion of the transverse momentum from the liquid which contains most of the momentum, from the vapor. As the fluid is separated, each turbine can be optimized for the interacting phase. The reaction of the turbine causes the rotor assembly to rotate about its axis, creating the centrifugal force, which created the trapping local potential wells for the fluid.

While the mass of the liquid transiting the compressor and expander stages is equal, the velocity is not. Thus, as with the turbojet, the turbine can power the compression with only a part of the exit rotational momentum. The remainder is converted to axial momentum providing propulsion.

Revolving the expanders by gearing, as in the external combustion embodiment described above, is possible. However, a turbine is simpler and, due to the much greater momentum of the liquid in this embodiment, efficient.

The nacelle 30 and the fairings 31, 31A, 31B, which fix the inlet and exit cones to it are shaped to allow low drag entry and exit of the water. It serves the functions of the nacelle in the turboprop.

CONCLUSIONS, RAMIFICATIONS, AND SCOPE

Accordingly, it can be seen that by using the local potential minimums of a body force to confine both the liquid and vapor components of a fluid, I have in this invention allowed the design of many embodiments of an engine that has the operational characteristics of the vane or piston engine but the fluid thruput characteristics and therefore the power density of a turbine.

While it has a turbine's flow characteristic's, this invention is operationally a piston engine an has that engine's insensitivity to design and fabrication detail. The total flow characteristic reduces sensitivity to contamination, reducing or eliminating the need for fluid preparation in geothermal applications. In an internal combustion embodiment, being continuous flow and continuous burn, it does not have the pistons engines short burn time nor require it s high temperature. The embodiments of this invention are less demanding in design, fabrication and input requirements then the conventional piston engine.

Although the description above contains many specificity, these should not be construed as limiting the scope of the invention but as merely providing illustrations of some of the presently preferred embodiments of this invention. Various other embodiments and ramifications are possible within it's scope. For example, while the body forces discussed above were gravitational and inertial, electromagnetic forces acting on conductive or magnetic fluids—such fluid are used in space programs—would allow much greater freedom in the arrangements of the local potential minimums and eliminate the need for a separate rotor.

There are many other obvious embodiments using different body forces and different arrangement of the axis. Thus the scope of the invention should be determined by the appended claims and their legal equivalents, rather than by the examples given.

What is claimed is:

1. A rotary liquid piston engine which converts the enthalpy of a two-phase fluid into rotary motion, said engine comprising a bi-phase fluid expanding assembly having an intake and an exit, bearings and axles mounting said assembly to a frame such that said expanding assembly can rotate with respect to a body force piping means providing a delivery of a bi-phase fluid to the intake of the assembly and removing it from the exit, coupled shafts and gearing which allow the motion of the assembly to do work, said bi-phase fluid expanding assembly consisting of: a rigid cylinder containing a plurality of cavities continuous from the fluid intake to the exit, said cavities being positioned and shaped such that said body force creates a sequence of potential energy minimums along each cavity, the liquid component of the bi-phase fluid being confined to the potential minimums of the body force consequently confining the vapor component between said cavities, said cavities being positioned and shaped such that, when rotated with respect to the body force the potential minimums move towards the exit, the volume between liquid pistons increases with motion towards the exit decreasing the pressure, an unbalanced pressure on the cavity walls results in torque being generated about the axis, and the fixed liquid component moves in the cavities, expands and allows the performance of work through said coupled shafts and gearing.

2. The total flow liquid piston engine as described in claim 1 wherein the body force is gravitational.

3. The total flow liquid piston engine as described in claim 1 wherein the body force is inertial and generated by the revolving of the multiple cylinder assemblies about a central axis.

4. The total flow liquid piston engine as described in claim 1 wherein said engine further comprises:

a compressive cavity section preceding the expanding cavity section, a carburetor and duct providing a means of introducing a fuel-air mixture to said compressing cavities, and, a means for igniting said fuel air mixture at a selected position in the flow of the mixture.

* * * * *